US012595533B2

(12) United States Patent
Gouverneyre

(10) Patent No.: US 12,595,533 B2
(45) Date of Patent: Apr. 7, 2026

(54) METHOD FOR RECYCLING ZINC (ZN)

(71) Applicant: REAZN BELGIUM, Kruisem (BE)

(72) Inventor: Jean Gouverneyre, Kruisem (BE)

(73) Assignee: REAZN BELGIUM, Kruisem (BE)

( * ) Notice: Subject to any disclaimer, the term of this patent is extended or adjusted under 35 U.S.C. 154(b) by 0 days.

(21) Appl. No.: 18/572,408

(22) PCT Filed: Dec. 21, 2022

(86) PCT No.: PCT/EP2022/087219
§ 371 (c)(1),
(2) Date: Dec. 20, 2023

(87) PCT Pub. No.: WO2023/126274
PCT Pub. Date: Jul. 6, 2023

(65) Prior Publication Data

US 2024/0263269 A1 Aug. 8, 2024

(30) Foreign Application Priority Data

Dec. 27, 2021 (BE) ..... 2021/6076

(51) Int. Cl.
*C22B 19/30* (2006.01)
*C22B 7/00* (2006.01)
*C22B 7/04* (2006.01)

(52) U.S. Cl.
CPC ..... *C22B 19/30* (2013.01); *C22B 7/004* (2013.01); *C22B 7/005* (2013.01); *C22B 7/04* (2013.01)

(58) Field of Classification Search
CPC ..... C22B 19/30; C22B 19/32; C22B 7/004; C22B 7/005; C22B 7/04; Y02P 10/20
See application file for complete search history.

(56) References Cited

U.S. PATENT DOCUMENTS 6,770,249 B1 * 8/2004 Hoboy ..... C22B 3/46 423/150.3
6,863,873 B1 * 3/2005 Hoboy ..... C22B 7/02 423/104
8,245,962 B2 8/2012 Didion
2020/0332392 A1 * 10/2020 Drouet ..... C22B 19/20

FOREIGN PATENT DOCUMENTS

| | | | |
|---|---|---|---|
| CA | 1336135 | C | 7/1995 |
| CN | 102423803 | A | 4/2012 |
| CN | 105087958 | A | 11/2015 |
| GB | 1353990 | A | 5/1974 |
| WO | 2013056348 | A1 | 4/2013 |
| WO | 2021074528 | A1 | 4/2021 |

OTHER PUBLICATIONS

NPL: on-line translation of CN105087958A, Nov. 2015 (Year: 2015).*

* cited by examiner

*Primary Examiner* — Jie Yang
(74) *Attorney, Agent, or Firm* — FisherBroyles, LLP; Roger L. Browdy; James E. Mrose

(57) ABSTRACT

A method for recycling zinc (Zn), wherein the method comprises the following steps: providing a feed composition; adding the feed composition to a rotary oven; heating the added feed composition for producing a first liquid molten metal phase and a first supernatant dross; adding aluminum (Al) to the first liquid molten metal phase, wherein a second supernatant dross and a second liquid molten metal phase are formed; adding at least one flux to the second liquid molten metal phase, followed by at least one segregation step in which the second liquid molten metal phase is removed from the rotary oven; casting the second liquid molten metal phase, or adding the removed second liquid molten metal phase to a casting furnace; casting the second liquid molten metal phase from the casting furnace; wherein the method further comprises the steps of: removing the second supernatant dross from the rotary oven; subjecting the removed second supernatant dross to at least one crushing step and at least one sorting step for separating at least one zinc fraction and at least one zinc oxide fraction from the second supernatant dross; and using the at least one zinc fraction for contributing to provide the feed composition.

24 Claims, No Drawings

METHOD FOR RECYCLING ZINC (ZN)

FIELD OF THE INVENTION

The present invention relates to a method for recycling (Zn) from secondary feedstocks, also known as recyclable materials, optionally combined with primary sources, i.e. special high-grade zinc (SHG zinc), by pyrometallurgy. Recyclable materials may for instance be by-products, waste materials and end-of-life materials.

BACKGROUND OF THE INVENTION

Economic and human development have always been closely linked to the control and production of raw materials. At the same time, due to the continued growth of the global economy and of the world population, the demand for natural resources, such as fossil fuels, metals and minerals, increases. This not only raises the question of the depletion of natural resources, but also that of the consequences for the environment and the climate. Circular thinking is an approach that may help understand how materials such as zinc (Zn) find their way through mining, production, product life and recycling, but circular thinking also leads to effective measures for optimization and change in a comprehensive approach, such as for instance more resource efficient ways for producing, using, and then recycling zinc. Indeed, zinc recycling plays a key role in securing resources for maintenance and expansion of technologies and infrastructure in the future.

The yearly global production of zinc (Zn) is over 13 million tons. Over 50% of this amount is used for galvanizing, such as hot-dip galvanizing of steel, while the rest is mainly used for the production of brass, zinc alloys, semi-finished goods and zinc compounds such as zinc oxide and zinc sulfate.

Zinc goes through a complex life cycle from its mining as ore, through its refining and use in society, to the eventual collection and recycling of end-of-life products. Based on current tendencies where economic interests on the one hand, and interests of ecology and sustainability on the other hand, increasingly (seem to) go hand in hand, greater emphasis is placed on technologies for a more efficient use and high-grade recycling of zinc. Metal recycling processes, particularly metal recycling processes of a pyrometallurgical nature, are aimed, among other things, at recovering zinc (Zn) from recyclable materials. These zinc metal recycling processes, and also zinc metal production processes in general, typically comprise at least one and usually a plurality of pyrometallurgical process steps in which zinc (Zn) and zinc oxides both occur in a liquid molten zinc metal phase, and wherein one or more supernatant slag phases are formed. Such supernatant slag phases comprise various ashes, metal oxides (such as zinc oxide (ZnO)) and intermetallic compounds (such as for instance Fe—Al intermetallic compounds), and due to gravity, come floating as separate and typically lighter phases on top of a molten zinc metal phase. These one or more supernatant slag phases are usually removed from the process as a separate stream, in order to obtain a high-grade molten zinc metal phase of a desired purity. However, upon removal, these supernatant slag phases, being the by-products of the zinc metal production, still contain significant trapped amounts of the desired zinc (Zn) to be recycled. For economic reasons, it is desirable to still extract the zinc (Zn) as efficiently as possible from the removed supernatant slag phases before disposing of the residue to be used elsewhere in other, often lower-value applications.

Known techniques for removing, i.e., recovering, zinc (Zn) from supernatant slag phases are known in the art, such as for instance and notably described in CN 102423803 A and WO 2013/056348 A1.

It is apparent from the above that there is a need for an improved method for recycling zinc (Zn), which method allows a higher final yield of zinc (Zn) to be achieved, combined with a higher (energy) efficiency, higher processing volumes, no landfill waste, higher environmental friendliness, and a lower carbon footprint.

SUMMARY OF THE INVENTION

The inventors have now surprisingly found that it is possible to obtain a method for recycling zinc (Zn) fulfilling the above-mentioned needs.

Therefore, there is now provided a method for recycling zinc (Zn), wherein the method comprises the following steps:

a) providing a feed composition, wherein the feed composition comprises zinc (Zn) and further comprises iron (Fe);
b) adding the feed composition to a rotary oven;
c) heating the added feed composition in the rotary oven, while rotating, to a temperature of at least 420° C. for producing a first liquid molten metal phase and a first supernatant dross which under the influence of gravity comes floating on top of the first liquid molten metal phase;
d) adding aluminum (Al) to the first liquid molten metal phase in the presence of the first supernatant dross, wherein the iron (Fe) present at least partially reacts with the added aluminum (Al) so as to form at least one intermetallic compound, and wherein a second supernatant dross is formed which under the influence of gravity comes floating on top of a second liquid molten metal phase;
e) adding at least one flux to the second liquid molten metal phase in the presence of the second supernatant dross, followed by at least one segregation step in which the second liquid molten metal phase is at least partially removed from the rotary oven;
f) adding the removed second liquid molten metal phase into at least one mold for casting the second liquid molten metal phase, or adding the removed second liquid molten metal phase to a casting furnace, wherein the second liquid molten metal phase is kept at a temperature of at least 400° C. in the casting furnace;
g) casting the second liquid molten metal phase from the casting furnace into at least one mold;

wherein the method further comprises the steps of:

h) removing the second supernatant dross from the rotary oven;
i) subjecting the removed second supernatant dross to at least one crushing step and at least one sorting step for separating at least one zinc fraction and at least one zinc oxide fraction from the second supernatant dross; and
j) adding the at least one zinc fraction obtained in step i) to step a) so as to contribute to providing the feed composition in step a).

DETAILED DESCRIPTION

The term "comprising", as used in the claims, should not be interpreted as being limited to the means mentioned thereafter; such a term does not exclude other elements or steps. The term should be read as specifying the presence of the stated features, integers, steps, or components, without, however, precluding the presence or addition of one or more other features, integers, steps or components, or groups thereof. Thus, the scope of the expression "a method comprising steps A and B" should not be limited to the method consisting only of steps A and B. This means that, with respect to the present invention, the only relevant steps of the method are A and B. Accordingly, the terms "comprising" and "including" encompass the more limiting terms "consisting essentially of" and "consisting of".

Within the scope of the present invention, the term "optional(ly)" means that an event or circumstance as described may or may not occur, and that the description comprises cases in which that event or circumstance occurs and cases in which it does not.

In this document and unless specified otherwise, amounts of metals and oxides are expressed in accordance with the typical practice in pyrometallurgy. The presence of each metal is typically expressed in its total presence, regardless whether the metal is present in its elemental form (oxidation state=0) or in any chemically bound form, typically in an oxidized form (oxidation state>0). For the metals which may relatively easily be reduced to their elemental forms, and which may occur as molten metal in the pyrometallurgical process, it is fairly common to express their presence in terms of their elemental metal form, even when the composition of a slag is given, in which the majority of such metals may actually be present in an oxidized form. For this reason, the composition of a slag such as the slag obtained in the process according to the present invention specifies the content of Fe, Zn, Pb, Cu, Sb, Bi, Ni, Cr as elemental metals. Less noble metals are more difficult to reduce under non-ferrous pyrometallurgical conditions and occur mostly in an oxidized form. These metals are then typically expressed in terms of their most common oxide form. Therefore, in slag or dross compositions, the content of Si, Ca, Al, Na is typically expressed as $SiO_2$, CaO, $Al_2O_3$, $Na_2O$, respectively.

As said above, according to step a) of the method according to the present invention, a feed composition is provided, wherein the feed composition comprises zinc (Zn) and further comprises iron (Fe).

Within the context of the present invention, it is therefore understood that the feed composition, as detailed above, is provided in such a way that said feed composition comprises zinc (Zn) and further comprises iron (Fe). The zinc (Zn) may be contained in the feed composition in the form of a zinc metal alloy. The iron (Fe) may be contained in the feed composition in the form of an iron metal alloy.

Within the scope of the present invention, such a feed composition, as detailed above, may be provided, i.e. be composed, from one or more secondary feedstocks, also known as recyclable materials, optionally combined with one or more primary sources, i.e. special high-grade zinc (SHG zinc) having for instance a zinc content of 99.995%, according to a given recipe with regard to the presence of zinc (Zn) combined with one or more non-zinc metal components, such as iron (Fe), and aluminum (Al), and their respective amounts as present in the given feed composition. These secondary feedstocks, also known as recyclable materials, may come from a wide variety of sources and therefore comprise a wide variety of compounds. Recyclable materials may for instance be by-products, waste materials and end-of-life materials.

Moreover, it is known that secondary feedstocks have a (significantly) lower carbon footprint compared to primary raw materials. The recovery of zinc (Zn) from secondary feedstocks has become an activity of paramount importance over the years. The recycling of zinc (Zn) after use has become an important contributor in the industry due to the continuing demand for said zinc (Zn) and the declining availability of high-quality fresh zinc metal ores.

Non-limiting examples of secondary feedstocks also comprise supernatant slag phases comprising zinc (Zn) and zinc oxide (ZnO), which supernatant slag phases may come from external zinc plants, zinc alloy plants, zinc recycling plants and zinc alloy recycling plants. Within the scope of the present invention, such external supernatant slag phases are preferably first subjected to at least one crushing step and at least one sorting step, or alternatively to at least one sorting step in case of an external supernatant slag phase that already consists of a particulate material with small particles that may eliminate the need for the at least one crushing step, for separating at least one external zinc fraction and at least one external zinc oxide fraction from these external supernatant slag phases. Adding a too large fraction of zinc oxide (ZnO) to the feed composition for use in the method according to the present invention should preferably be avoided, as the presence of zinc oxide (ZnO) in the feed composition will directly lead to reduced (energy) efficiency and lower yields for the entire method for recycling zinc (Zn) according to the present invention.

In an embodiment of the present invention, the at least one external supernatant slag phase is subjected to at least one crushing step and at least one sorting step by adding the at least one external supernatant slag phase into a rotating perforated drum such as the one described in U.S. Pat. No. 8,245,962 B2. In such a rotating perforated drum, the at least one external supernatant slag phase is first subjected to at least one crushing step, in which the incoming at least one external supernatant slag phase is systematically broken up using crushing means, particularly wherein the crushing means are selected from teeth, blades, spines, or any combination thereof, into a particulate material of a different particle size. Particulate material thus formed is subjected, during or after the at least one crushing step, to at least one sorting step by sieve-based separation in the presence of an aeraulic countercurrent in the rotating perforated drum, i.e. being a densimetric separation based on a counterflow of air, for separating at least one external zinc oxide fraction and at least one external zinc fraction, wherein said external zinc oxide fraction is characterized in general by a lower density than said external zinc fraction, and wherein said lighter external zinc oxide fraction is thus densimetrically separated and removed from said heavier external zinc fraction. Preferably, said rotating perforated drum is further equipped with at least one magnetic conveyor belt for at least partially removing metallic iron (Fe) from the at least one external supernatant slag phase.

In another embodiment of the present invention, the at least one external supernatant slag phase is subjected to at least one sorting step, particularly in case the at least one external supernatant slag phase already consists of a particulate material with small particles, by adding the at least one external supernatant slag phase into a device such as the one described in WO 2021/074528 A1. In such a device, the at least one external supernatant slag phase is subjected to at least one sorting step by aeraulic separation, i.e. being a densimetric separation, for separating at least one external zinc oxide fraction and at least one external zinc fraction, wherein said external zinc oxide fraction is characterized in general by a lower density than said external zinc fraction, and wherein said lighter external zinc oxide fraction is thus densimetrically separated and removed from said heavier external zinc fraction. Preferably, said device is further equipped with at least one magnetic drum for at least partially removing metallic iron (Fe) from these external supernatant slag phases.

In an embodiment of the present invention, the method, as detailed above, comprises a first step, i.e. a step carried out before step a) of said method, wherein the incoming secondary feedstocks are sorted based on their origin, their chemical composition with regard to the presence of zinc (Zn) combined with one or more non-zinc metal components, such as iron (Fe), and aluminum (Al), and the final target alloy for which these secondary feedstocks will be used. As detailed above, the incoming secondary feedstocks, particularly when said incoming secondary feedstocks are external supernatant slag phases comprising zinc (Zn) and zinc oxide (ZnO), may optionally be subjected to at least one crushing step and at least one sorting step, or alternatively to at least one sorting step in case of an external supernatant slag phase that already consists of a particulate material with small particles that may eliminate the need for the at least one crushing step, for separating at least one external zinc fraction and at least one external zinc oxide fraction from these external supernatant slag phases, and optionally also other metals such as metallic iron (Fe).

In general, a person skilled in the art is familiar with available analysis techniques for determining the chemical composition of secondary feedstocks with regard to the presence of zinc (Zn) and other non-zinc metal components. Non-limiting examples of such analysis techniques are organoleptic techniques, and optical emission spectroscopy (OES).

As for the amount of zinc (Zn) as comprised in the feed composition, relative to the total weight of the feed composition, zinc (Zn) may be present in any amount ranging from 0.10 to 99.99 wt. %.

Preferably, zinc (Zn) is present, relative to the total weight of the feed composition, in an amount higher than or equal to 0.10 wt. %, preferably higher than or equal to 1.00 wt. %, preferably higher than or equal to 5.00 wt. %, preferably higher than or equal to 10.00 wt. %, preferably higher than or equal to 20.00 wt. %, preferably higher than or equal to 30.00 wt. %, preferably higher than or equal to 40.00 wt. %, preferably higher than or equal to 50.00 wt. %, preferably higher than or equal to 60.00 wt. %, preferably higher than or equal to 70.00 wt. %, preferably higher than or equal to 80.00 wt. %, preferably higher than or equal to 90.00 wt. %, preferably higher than or equal to 93.00 wt. %, preferably higher than or equal to 95.00 wt. %, preferably higher than or equal to 97.50 wt. %, preferably higher than or equal to 98.00 wt. %.

As for the amount of iron (Fe) as comprised in the feed composition, this amount of iron (Fe) is not limited in principle, since the person skilled in the art can choose the amount of iron (Fe) as comprised in the feed composition in such a way that a proper operation of the method according to the present invention is guaranteed. In general, iron (Fe) is present, relative to the total weight of the feed composition, in an amount ranging from 0.001-7.000 wt. %, preferably ranging from 0.001-5.000 wt. %, preferably ranging from 0.001-3.000 wt. %, preferably ranging from 0.001-2.000 wt. %, preferably ranging from 0.001-1.000 wt. %.

In an embodiment of the method according to the present invention, the feed composition consists essentially of zinc (Zn) in an amount ranging from 93.00-99.99 wt. % and iron (Fe) in an amount ranging from 0.001-7.000 wt. %, relative to the total weight of the feed composition.

Within the scope of the present invention, the feed composition, in addition to zinc (Zn) and iron (Fe), may comprise smaller amounts of other metals. Non-limiting examples of such other metals are aluminum (Al), silicon (Si), nickel (Ni), lead (Pb), magnesium (Mg), manganese (Mn), cerium (Ce), tin (Sn), copper (Cu), lanthanum (La), antimony (Sb), arsenic (As), bismuth (Bi), germanium (Ge), tellurium (Te), cobalt (Co), selenium (Se), thallium (Tl), gallium (Ga), silver (Ag), gold (Au), platinum (Pt), palladium (Pd), ruthenium (Ru), rhodium (Rh), osmium (Os), and iridium (Ir). The feed composition may also comprise elements which are not considered a metal, such as sulfur (S), carbon (C) and oxygen (O).

As said, according to step b) of the method according to the present invention, the feed composition, as detailed above, is added to a rotary oven.

Within the context of the present invention, it is therefore understood that the feed composition, as detailed above, can be added into the rotary oven as a whole, or, alternatively, that the different components making up the feed composition can be added separately to the rotary oven so as to form said feed composition in the rotary oven.

In general, known rotary ovens can be used, such as those used in the pyrometallurgic domain and known to the person skilled in the art. Non-limiting examples of rotary ovens are for instance and notably described in CA 1336135 C and WO 2013/056348 A1.

Within the context of the present invention, a rotary oven is intended to denote an oven having a chamber, such as a cylindrical chamber, wherein the chamber is coated with a suitable refractory material, such as refractory concrete, and is heated from the inside. The chamber can be placed with its axis generally horizontal, and a mechanism is provided for tilting the oven over a transverse axis. The rotary oven is provided with a rotating and tilting function and is also able to be closed. Heating may be carried out by burning fuel or natural gas (with oxygen) with a direct, double or dual pass flame in the oven, plasma torches, or electric arcs. Preferably, heating is carried out by burning natural gas (with oxygen) with a direct, double or dual pass flame in the oven. Furthermore, the rotary oven is provided with a flue or a chimney, at least one oxygen burner, a doorstop, an oven entrance, and a hinged door. The theoretical capacity of the rotary oven generally ranges from 30-50 tons.

As said, according to step c) of the method according to the present invention, the added feed composition, as detailed above, is heated in the rotary oven, while rotating, to a temperature of at least 420° C. for producing a first liquid molten metal phase and a first supernatant dross which under the influence of gravity comes floating on top of the first liquid molten metal phase.

Preferably, the added feed composition, as detailed above, is heated in the rotary oven, while rotating, to a temperature of at least 450° C., preferably to a temperature of at least 500° C., preferably to a temperature of at least 550° C., preferably to a temperature of at least 600° C.

Furthermore, it should be understood that the upper limit of the temperature for heating in the rotary oven while rotating the added feed composition, as detailed above, is equal to or lower than 900° C., or equal to or lower than 880° C., or equal to or lower than 860° C., or equal to or lower than 850° C.

In a preferred embodiment of step c) of the method according to the present invention, the added feed composition, as detailed above, is heated in the rotary oven, while rotating, to a temperature ranging from 420-900° C., or ranging from 450-900° C., or ranging from 500-880° C., or ranging from 550-860° C., or ranging from 600-850° C.

Within the context of the present invention, "first supernatant dross" is intended to denote an often lighter paste-like substance that forms as a result of an operational step, and that separates from a denser first liquid molten metal phase, usually under the influence of gravity, and usually comes floating on top of said first liquid molten metal phase. The first supernatant dross is therefore usually able to be mechanically scraped off or removed from the underlying first liquid molten metal phase. The first supernatant dross is usually rich in various undesired components such as ashes, and metal oxides (such as zinc oxide (ZnO)), combined with a significant amount of the first liquid molten metal phase comprising the zinc (Zn) to be recycled still trapped therein.

Within the context of the present invention, "a first liquid molten metal phase" is intended to denote a denser liquid molten zinc metal phase that forms as a result of an operational step, and that separates from the first supernatant dross, as detailed above, usually under the influence of gravity, and wherein these first liquid molten metal phase mainly comprises zinc (Zn) and fewer undesired components such as ashes, and metal oxides (such as zinc oxide (ZnO)), since these undesired components are now at least partially comprised in the first supernatant dross.

Within the scope of the present invention, the person skilled in the art can, according to standard practice, provide the rotary oven with a suitable rotation speed while heating the feed composition added thereto, as detailed above, for producing the first liquid molten metal phase, as detailed above, and the first supernatant dross, as detailed above, which under the influence of gravity comes floating on top of the first liquid molten metal phase.

Within the scope of the present invention, the person skilled in the art can adjust the rotation direction, the rotation speed, the at least partial tilting, the heating intensity of the rotary oven while heating the added feed composition, as detailed above, so as to achieve an optimal separation of the first liquid molten metal phase, as detailed above, and the first supernatant dross, as detailed above, in said rotary oven.

As said, according to step d) of the method according to the present invention, aluminum (Al) is added to the first liquid molten metal phase in the presence of the first supernatant dross, wherein the iron (Fe) present at least partially reacts with the added aluminum (Al) so as to form at least one intermetallic compound, and wherein a second supernatant dross is formed which under the influence of gravity comes floating on top of a second liquid molten metal phase.

Within the context of step d) of the method according to the present invention, it is therefore understood that the aluminum (Al) added to the first liquid molten metal phase, as detailed above, may be present in the form of an aluminum metal alloy.

In order to produce a marketable zinc product, the iron (Fe) present needs to be at least partially removed (according to the standard used for the present and desired zinc metal alloy to be obtained), preferably fully removed. Iron (Fe) is a metal that can form intermetallic compounds with aluminum (Al). Thus, the iron (Fe) present in the first liquid molten metal phase, as detailed above, can at least partially, preferably fully, be reacted with the added aluminum (Al) so as to form at least one intermetallic compound, such as for instance $Fe_2Al_5$, wherein a second supernatant dross is formed which under the influence of gravity comes floating on top of a second liquid molten metal phase, and wherein the second supernatant dross formed comprises at least one intermetallic compound.

Within the context of the present invention, "second supernatant dross" is intended to denote an often lighter paste-like substance that forms as a result of an operational step, and that separates from a denser second liquid molten metal phase, usually under the influence of gravity, and usually comes floating on top of said second liquid molten metal phase. The second supernatant dross is therefore usually able to be mechanically scraped off or removed from the underlying second liquid molten metal phase. The second supernatant dross is usually rich in various undesired components such as ashes, and metal oxides (such as zinc oxide (ZnO)), similar to the first supernatant dross, as detailed above, and further at least one intermetallic compound (such as for instance Fe—Al intermetallic compounds) which is formed by an at least partial reaction of the iron (Fe) present in the first liquid molten metal phase by adding aluminum (Al) thereto. Furthermore, the second supernatant dross comprises a significant amount of the second liquid molten metal phase comprising the zinc (Zn) to be recycled still trapped therein.

Within the context of the present invention, "a second liquid molten metal phase" is intended to denote a denser liquid molten zinc metal phase that forms as a result of an operational step, and that separates from the second supernatant dross, as detailed above, usually under the influence of gravity, and wherein this second liquid molten metal phase mainly comprises zinc (Zn), optionally in the presence of other non-zinc metal components, and fewer undesired components such as ashes, and metal oxides (such as zinc oxide (ZnO)), and iron (Fe), since these undesired components are now at least partially comprised in the second supernatant dross.

In an embodiment of step d) of the method according to the present invention, aluminum (Al), optionally comprised in an aluminum metal alloy, is added to the first liquid molten metal phase in at least the stoichiometric amount needed to react with the amount of iron (Fe) present in the feed composition, as detailed above, or preferably at least 2% above stoichiometry, more preferably at least 5% above stoichiometry, even more preferably at least 10% above stoichiometry, such as 20%.

In an embodiment of step d) of the method according to the present invention, aluminum (Al), optionally comprised in an aluminum metal alloy, is added to the first liquid molten metal phase in a content of at most 200% of the stoichiometric amount needed to react with the amount of iron (Fe) present, preferably at most 150% of stoichiometry, more preferably at most 125% of stoichiometry, even more preferably at most 120% of stoichiometry, yet even more preferably at most 115% of stoichiometry.

The inventors have found that the above-mentioned amounts of aluminum (Al), optionally comprised in an aluminum metal alloy, are sufficient to obtain an acceptable removal of iron (Fe) present in the first liquid molten metal phase and to obtain the desired target concentrations of iron (Fe) in the second liquid molten metal phase, such as for instance target concentrations equal to or lower than 0.02 wt. % (200 ppm).

As said, according to step e) of the method according to the present invention, at least one flux is added to the second liquid molten metal phase in the presence of the second supernatant dross, followed by at least one segregation step in which the second liquid molten metal phase is at least partially removed from the rotary oven.

Non-limiting examples of a suitable flux for use in step e) of the method according to the present invention are ZnS, $ZnCl_2$, $NH_4Cl$, $(NH_4)_2ZnCl_4$, a hydrate or a mixture thereof.

In a preferred embodiment of step e) of the method according to the present invention, the at least one flux is selected from the group consisting of ZnS, $ZnCl_2$, $NH_4Cl$, $(NH_4)_2ZnCl_4$, hydrates and mixtures thereof.

Within the context of the present invention, the addition of the at least one flux, as detailed above, serves one or more functions, such as notably (further) purifying the second liquid molten metal phase, as detailed above, of undesired components and chemical impurities as comprised therein, further liquefying the second supernatant dross, as detailed above, in such a way that part of the amount of the second liquid molten metal phase comprising the zinc (Zn) to be recycled trapped in the second supernatant dross can now be brought back into the underlying second liquid molten metal phase, and reducing the amount of zinc oxide (ZnO).

The inventors have found that adding at least one flux to the second liquid molten metal phase in the presence of the second supernatant dross, particularly with the at least one flux selected from the group consisting of ZnS, $ZnCl_2$, $NH_4Cl$, $(NH_4)_2ZnCl_4$, hydrates and mixtures thereof, now allows part of the amount of the second liquid molten metal phase comprising the zinc (Zn) to be recycled trapped in the second supernatant dross to be successfully brought back into the underlying second liquid molten metal phase, without further contaminating this second liquid molten metal phase with for instance metal oxides and/or intermetallic compounds as comprised in the second supernatant dross.

After adding the at least one flux, as detailed above, to the second liquid molten metal phase, the added flux is contacted for a given time, such as for instance for a time of 15 to 30 minutes, with the second liquid molten metal phase and the second supernatant dross in the rotary oven while rotating, particularly while rotating in a tilted position of the rotary oven. For good results, the axis of the rotary oven may for instance form an angle of 15 to 20 degrees relative to the horizontal.

The addition of the at least one flux, as detailed above, to the second liquid molten metal phase in the presence of the second supernatant dross, as detailed above, and the contacting of the added flux with the second liquid molten metal phase and the second supernatant dross for a certain time in the rotary oven while rotating, is followed by at least one segregation step in which the second liquid molten metal phase is at least partially removed from the rotary oven. The second liquid molten metal phase accumulated under the second supernatant dross can, in one or more cycles, be segregated, particularly poured, from the rotary oven, wherein the second supernatant dross, due to its more solid form when compared to the second liquid molten metal phase, remains in the rotary oven when pouring the second liquid molten metal phase. The segregation of the second liquid molten metal phase from the rotary oven during at least one segregation step may be carried out via the entrance of the rotary oven.

After the at least partial removal of the second liquid molten metal phase from the rotary oven by the at least one segregation step, the oven door of the rotary oven remains closed (while the rotary oven rotates) and the rotary oven is provided with an inert gas atmosphere for reducing or preventing exothermal reactions in the rotary oven with formation of the undesired zinc oxide from the desired zinc (Zn) to be recycled. Non-limiting examples of usable inert gasses for achieving such an inert gas atmosphere are nitrogen gas and argon gas.

After the second liquid molten metal phase, as detailed above, has been at least partially removed from the rotary oven during one segregation step, it is deemed advantageous for the rotary oven again to be rotated for a certain time, since the second supernatant dross, as detailed above, has a high degree of humidification with a significant amount of the second liquid molten metal phase comprising the zinc (Zn) to be recycled still trapped therein.

In a preferred embodiment of step e) of the method according to the present invention, the second liquid molten metal phase, as detailed above, is removed from the rotary oven during more than one segregation step, such as two segregation steps or three segregation steps.

The inventors have found that step e) of the method according to the present invention, i.e. the step comprising adding at least one flux, as detailed above, followed by at least one segregation step, preferably followed by more than one segregation step, allows a maximum amount of the second liquid molten metal phase, as detailed above, to be removed from the rotary oven, combined with a favorable ratio of zinc (Zn) yield versus energy consumed, which ratio leads to an increased sustainability of the method according to the present invention.

As said, according to an embodiment of the step f) of the method according to the present invention, the second liquid molten metal phase removed from the rotary oven, as detailed above, is added to at least one mold for casting said second liquid molten metal phase.

Non-limiting examples of suitable molds are ingot molds, and block molds.

The second liquid molten metal phase thus removed, as detailed above, after being cast into the at least one mold, is then cooled in order to become solid.

According to an alternative embodiment of the step f) of the method according to the present invention, the second liquid molten metal phase removed from the rotary oven, as detailed above, is added to a casting furnace, wherein the second liquid molten phase is kept at a temperature of at least 400° C. in the casting furnace.

Preferably, the added second liquid molten metal phase, as detailed above, is kept in the casting furnace at a temperature of at least 405° C., preferably at a temperature of at least 410° C., preferably at a temperature of at least 415° C.

Furthermore, it should be understood that the upper limit of the temperature for the added second liquid molten metal phase to be kept in the casting furnace, as detailed above, is equal to or lower than 900° C., preferably equal to or lower than 550° C., preferably equal to or lower than 500° C., preferably equal to or lower than 450° C., preferably equal to or lower than 430° C.

In a preferred embodiment of step f) of the method according to the present invention, the added second liquid molten metal phase, as detailed above, is kept in the casting furnace at a temperature ranging from 415-430° C. In general, known casting furnaces such as those used in the pyrometallurgic domain can be used and are known to the person skilled in the art.

Because the second liquid molten metal phase, as detailed above, is added to the casting furnace in a liquid molten state, and thus before cooling and solidifying of said metal phase, any loss of heat energy, any metal oxidation reactions of the zinc (Zn) as comprised in the second liquid molten metal phase, and any cooling of the casting furnace in case this would already contain a fraction of the second liquid molten metal phase, is thus avoided.

In an embodiment of the step f) of the method according to the present invention, further non-zinc metal components can be added to the added second liquid molten metal phase, as detailed above, in the casting furnace so as to produce in the casting furnace a final zinc metal alloy comprising the recycled zinc (Zn) having a desired chemical composition, and wherein this final zinc metal alloy comprising the recycled zinc (Zn) can then be cast from the casting furnace into at least one mold and cooled in order to become solid.

In general, a person skilled in the art is familiar with available analysis techniques for determining the chemical composition of metal phases and/or metal alloys feedstocks with regard to the presence of zinc (Zn) and other non-zinc metal components. A non-limiting example of such an analysis technique is optical emission spectroscopy (OES).

As a non-limiting example, copper (Cu) may for instance be added to the added second liquid molten metal phase, as detailed above, in the casting furnace so as to produce in the casting furnace a final zinc metal alloy comprising the recycled zinc (Zn) having an amount of copper (Cu) ranging from 0.001 to 5 wt. %, relative to the total weight of the final zinc metal alloy comprising the recycled zinc (Zn), and wherein said final zinc metal alloy can then be cast from the casting furnace into at least one mold and cooled in order to become solid.

As another non-limiting example, the added second liquid molten metal phase, as detailed above, in the casting furnace may already comprise an amount of molten-in aluminum (Al), particularly when in an embodiment of step d) of the method according to the present invention, as detailed above, aluminum (Al), optionally comprised in an aluminum metal alloy, was added to the first liquid molten metal phase in the presence of the first supernatant dross, as detailed above, in an amount greater than the stoichiometric amount needed to react with the amount of iron (Fe) present in the first liquid molten metal phase. Thus, for instance, a final zinc metal alloy comprising the recycled zinc (Zn) may be produced having an amount of copper (Cu) ranging from 0.50 to 3 wt. % and having an amount of aluminum (Al) ranging from 2 to 8 wt. %, relative to the total weight of the final zinc metal alloy comprising the recycled (Zn), and wherein said final zinc metal alloy can then be cast from the casting furnace into at least one mold and cooled in order to become solid.

As said, according to step g) of the method according to the present invention, the second liquid molten metal phase, as detailed above, is added from the casting furnace to at least one mold for casting said metal phase in said at least one mold.

Non-limiting examples of suitable molds are ingot molds, and block molds.

The second liquid molten metal phase, as detailed above, after being removed from the casting furnace and after being cast into the at least one mold, is then cooled in order to become solid.

As said, according to step h) of the method according to the present invention, the second supernatant dross, as detailed above, is removed from the rotary oven.

Removing the second supernatant dross, as detailed above, from the rotary oven may be carried out via the entrance of the rotary oven, which entrance of the rotary oven was also used in step e) of the method according to the present invention for at least partially removing the second liquid molten metal phase, as detailed above, from the rotary oven during at least one segregation step.

The second supernatant dross thus removed, as described detailed, is then cooled in order to become solid.

As said, according to step i) of the method according to the present invention, the removed second supernatant dross, as detailed above, is subjected to at least one crushing step and at least one sorting step for separating at least one zinc fraction and at least one zinc oxide fraction from the second supernatant dross.

Within the context of step i) of the method according to the present invention, the at least one zinc fraction may be in the form of a zinc metal alloy.

In an embodiment of step i) of the method according to the present invention, said at least one crushing step may be carried out by means of crushing means selected from teeth, blades, spines, or any combination thereof, wherein the incoming second supernatant dross, as detailed above, is systematically broken up into a particulate material of a different particle size.

In an embodiment of step i) of the method according to the present invention, said at least one sorting step may be carried out by sieve-based separation in the presence of an aeraulic countercurrent, i.e. being a densimetric separation based on a counterflow of air.

In an embodiment of the present invention, the at least one crushing step, as detailed above, and at least one sorting step, as detailed above, as mentioned in step i) of the method according to the present invention, may be carried out by adding the second supernatant dross, as detailed above, into a rotating perforated drum such as the one described in U.S. Pat. No. 8,245,962 B2. In such a rotating perforated drum, the removed second supernatant dross, as detailed above, is first subjected to at least one crushing step, in which the incoming second supernatant dross is systematically broken up using crushing means, particularly wherein the crushing means are selected from teeth, blades, spines, or any combination thereof, into a particulate material of a different particle size. Particulate material thus formed is subjected, during or after the at least one crushing step, to at least one sorting step by sieve-based separation in the presence of an aeraulic countercurrent in the rotating perforated drum, i.e. being a densimetric separation based on a counterflow of air, for separating at least one zinc oxide fraction and at least one zinc fraction, wherein said zinc oxide fraction is characterized in general by a lower density than said zinc fraction, and wherein said lighter zinc oxide fraction is thus densimetrically separated and removed from said heavier zinc fraction.

In a preferred embodiment, the rotating perforated drum, as detailed above, is further provided with one or more magnetic means for removing, i.e. extracting, metallic iron (Fe) if present in the second supernatant dross.

As said, according to step j) of the method according to the present invention, the at least one zinc fraction obtained in step i), as detailed above, is added to step a) so as to contribute to providing the feed composition, as detailed above, in step a).

The inventors have found that the method according to the present invention thus allows a maximal extraction and recycling of zinc (Zn) to be achieved in the form of the at least one zinc fraction, as detailed above, by further subjecting the second supernatant dross, as detailed above, after removing the second supernatant dross from the rotary oven, to the at least one crushing step and the at least one sorting step, as detailed above, for separating the at least one zinc fraction and the at least one zinc oxide fraction from the second supernatant dross. The zinc (Zn) thus recovered then serves to contribute to provide the feed composition in step a), directly allowing a higher final yield of zinc (Zn) to be achieved, combined with a higher (energy) efficiency, higher processing volumes, no landfill waste, and a lower carbon footprint.

The inventors have further found that the method of the present invention comprising the steps a)-j) as a whole thus allows a higher final yield of zinc (Zn) to be achieved, combined with a higher (energy) efficiency, higher processing volumes, no landfill waste, higher environmental friendliness, and a lower carbon footprint.

The at least one zinc oxide fraction, as detailed above, and as obtained in step i) of the method according to the present invention, can further be applied in other, often lower-value applications, such as for instance as an activator for rubber vulcanization or as an additive or filler for plastics, ceramics, glass, and cement.

The invention claimed is:

1. A method for recycling zinc (Zn), wherein the method comprises the following steps:

a) providing a feed composition, wherein the feed composition comprises, relative to the total weight of the feed composition, an amount of zinc (Zn) higher than or equal to 40.00 wt. %, and wherein the feed composition further comprises an amount of iron (Fe) ranging from 0.001-7.000 wt. %;

b) adding the feed composition to a rotary oven;

c) heating the added feed composition in the rotary oven, while rotating, to a temperature ranging from 420-900° C. for producing a first liquid molten metal phase and a first supernatant dross which under the influence of gravity comes floating on top of the first liquid molten metal phase;

d) after step c), actively adding aluminum (Al) to the first liquid molten metal phase in the presence of the first supernatant dross, wherein the iron (Fe) present at least partially reacts with the added aluminum (Al) so as to form at least one intermetallic compound, and wherein a second supernatant dross is formed which under the influence of gravity comes floating on top of a second liquid molten metal phase;

e) after step d), actively adding at least one flux to the second liquid molten metal phase in the presence of the second supernatant dross, followed by at least one segregation step in which the second liquid molten metal phase is at least partially removed from the rotary oven;

f) adding the removed second liquid molten metal phase into at least one mold for casting the second liquid molten metal phase, or adding the removed second liquid molten metal phase to a casting furnace, wherein the second liquid molten metal phase is kept at a temperature of at least 400° C. in the casting furnace;

g) casting the second liquid molten metal phase from the casting furnace into at least one mold;

wherein the method further comprises the steps of:

h) removing the second supernatant dross from the rotary oven;

i) subjecting the removed second supernatant dross to at least one crushing step and at least one sorting step for separating at least one zinc fraction and at least one zinc oxide fraction from the second supernatant dross; and j) adding the at least one zinc fraction obtained in step i) to step a) so as to contribute to providing the feed composition in step a).

2. Method according to claim 1, wherein the feed composition is provided from one or more secondary feedstocks.

3. Method according to claim 2, wherein the one or more secondary feedstocks are first subjected to at least one sorting step, for separating at least one external zinc fraction and at least one external zinc oxide fraction.

4. Method according to claim 3, wherein the at least one sorting step is preceded by at least one crushing step.

5. Method according to claim 1, wherein the feed composition, relative to the total weight of the feed composition, comprises an amount of zinc (Zn) higher than or equal to 50.00 wt. %.

6. Method according to claim 1, wherein the feed composition, relative to the total weight of the feed composition, comprises an amount of iron (Fe) ranging from 0.001-5.000 wt. %.

7. Method according to claim 1, wherein in step c) the added feed composition is heated in the rotary oven, while rotating, to a temperature ranging from 450-900° C.

8. Method according to claim 1, wherein in step d) aluminum (Al) is added to the first liquid molten metal phase in at least the stoichiometric amount needed to react with the amount of iron (Fe) present in the feed composition.

9. Method according to claim 1, wherein in step d), aluminum (Al) is added to the first liquid molten metal phase in a content of at most 200% of the stoichiometric amount needed to react with the amount of iron (Fe) present.

10. Method according to claim 1, wherein in step e), the at least one flux is selected from the group consisting of ZnS, $ZnCl_2$, $NH_4Cl$, $(NH_4)_2ZnCl_4$, hydrates and mixtures thereof.

11. Method according to claim 1, wherein in step e), the second liquid molten metal phase from the rotary oven is removed during two segregation steps or three segregation steps.

12. Method according to claim 1, wherein in step f), the added second liquid molten metal phase is kept at a temperature of at least 405° C. in the casting furnace.

13. Method according to claim 12, wherein in step f), the added second liquid molten metal phase is kept at a temperature of at least 410° C. in the casting furnace.

14. Method according to claim 13, wherein in step f), the added second liquid molten metal phase is kept at a temperature of at least 415° C. in the casting furnace.

15. Method according to claim 1, wherein in step f), the added second liquid molten metal phase is kept at a temperature of at least 400° C. and equal to or lower than 900° C. in the casting furnace.

16. Method according to claim 15, wherein in step f), the added second liquid molten metal phase is kept at a temperature of at least 400° C. and equal to or lower than 550° C. in the casting furnace.

17. Method according to claim 16, wherein in step f), the added second liquid molten metal phase is kept at a temperature of at least 400° C. and equal to or lower than 500° C. in the casting furnace.

18. Method according to claim 17, wherein in step f), the added second liquid molten metal phase is kept at a temperature of at least 400° C. and equal to or lower than 450° C. in the casting furnace.

19. Method according to claim 18, wherein in step f), the added second liquid molten metal phase is kept at a temperature of at least 400° C. and equal to or lower than 430° C. in the casting furnace.

20. Method according to claim 1, wherein in step f), further non-zinc metal components are added to the added second liquid molten metal phase in the casting furnace.

21. Method according to claim 1, wherein in step i), the at least one crushing step is carried out using crushing means selected from teeth, blades, spines, or any combination thereof.

22. Method according to claim 21, wherein step i) is carried out in a rotating perforated drum.

23. Method according to claim 22, wherein the rotating perforated drum is further provided with one or more magnetic means for removing metallic iron (Fe).

24. Method according to claim 1, wherein in step i), the at least one sorting step is carried out by sieve-based separation in the presence of an aeraulic countercurrent.

* * * * *